United States Patent [19]

Sjögren et al.

[11] Patent Number: 4,569,621

[45] Date of Patent: Feb. 11, 1986

[54] METHOD OF AND AN APPARATUS FOR MANUFACTURING A RING-PULL BOTTLE CAP

[75] Inventors: Börje Sjögren, Huddinge; Jan Berglund, Västra Frölunda, both of Sweden

[73] Assignee: Wicanders AB, Alvangen, Sweden

[21] Appl. No.: 574,873

[22] Filed: Jan. 30, 1984

[30] Foreign Application Priority Data

Feb. 1, 1983 [JP] Japan ..... 58-13855
Feb. 1, 1983 [JP] Japan ..... 58-13856

[51] Int. Cl.[4] ..... B21D 51/44

[52] U.S. Cl. ..... 413/14; 413/25; 413/66

[58] Field of Search ..... 413/14, 16, 25, 66, 413/15, 64, 67; 72/405; 215/255, 250

[56] References Cited

U.S. PATENT DOCUMENTS

| | | | |
|---|---|---|---|
| 3,952,900 | 4/1976 | Rausing | 215/255 |
| 4,037,551 | 7/1977 | Lewis | 413/16 |
| 4,227,619 | 10/1980 | Magnusson | 215/255 |
| 4,341,498 | 7/1982 | Ellis | 413/64 |
| 4,453,644 | 6/1984 | Berglund | 215/255 |

*Primary Examiner*—Francis S. Husar

*Assistant Examiner*—Robert Showalter

*Attorney, Agent, or Firm*—Brumbaugh, Graves, Donohue & Raymond

[57] ABSTRACT

A method of manufacturing a bottle cap provided with a ring-pull is disclosed, in which a band is cut from a metal strip by shears and is simultaneously curled up, by shear bow, to form a cylindrical band with overlapping ends, while a bottle cap portion with a tab is prepared separately from another metal sheet. Then, the cylindrical band is firmly connected to the tab of the cap by rolling the cylindrical band up from one edge, to form a toroid while rolling the tab up into the band. The method may be carried out using apparatus including a transporting turret for transferring the cylindrical band to a pulling ring former for forming the pulling ring, a feeder for feeding the bottle cap to a turret anvil carried by the turret; a pressing device for urging a bottle cap tap against the cylindrical band; a roller mechanism for rolling the bottle cap tab and the cylindrical band up to form the pulling ring while joining the latter to the bottle cap; and a device for embossing the region of the joint between the pull-ring and the tear tab. The invention allows bottle caps with ring-pulls to be produced on a mass production basis with minimum loss of material.

25 Claims, 20 Drawing Figures

METHOD OF AND AN APPARATUS FOR MANUFACTURING A RING-PULL BOTTLE CAP

FIELD OF THE INVENTION

The invention relates to a method of and an apparatus for manufacturing a ring-pull bottle cap.

BACKGROUND

Recently a conveniently openable bottle cap, referred to herein as a ring-pull bottle cap has become popular, which is provided with continuous score lines extending over the rim and top of the bottle cap and defining therebetween a strip, which is integral with a tear tab extending from the skirt of the cap, and which strip can be torn from the remainder, along the score lines, by pulling the tear tab, to remove the cap from the bottle. To remove a bottle cap of this type in this fashion a considerable force must be exerted on the tear tab, and therefore a good grip is required. For this purpose, the tear tab is made relatively long and is provided with a suitable gripping formation. However, such a construction has the disadvantage of producing a large amount of scrap because the bottle caps are made from blanks stamped out of sheet metal, and the necessary form of the blanks means that relatively large areas of the metal sheet must be left between adjacent blanks stamped therefrom. This construction is therefore expensive to produce. There has also been proposed a construction in which a separately produced gripping piece is subsequently connected to a relatively short tear tab on a cap by, for example, bonding, rivetting or clipping. However, such a construction has the disadvantage of being labor and time consuming, of producing a weak point likely to break in use before the cap is successfully opened, and is generally expensive.

SUMMARY OF THE INVENTION

Accordingly, a general object of the invention is to provide a method of and apparatus for manufacturing a ring-pull bottle cap by which the material loss may be minimised, and mass production at relatively low cost be achieved, and by which, nevertheless, the finger-ring may be firmly connected to the tear tab.

According to one aspect of the invention there is provided a method of manufacturing a ring-pull bottle cap wherein a bottle cap blank is formed with a tear tab, a pulling ring blank is formed separately by cutting a strip from a metal sheet, and curling the strip to form an annular band in which the ends of the strips are overlapped, the tear tab of the cap blank is subsequently placed in juxtaposition with said annular band and the band rolled up from one edge, thereby simultaneously rolling the tear tab up into the band, to form the ring and provide a tight connection between the ring and the tear tab.

According to another aspect of the invention, there is provided an apparatus for use in manufacturing a ring-pull bottle cap including means for forming a bottle cap blank with a tear tab, means for cutting a strip from a metal sheet and curling the strip to form an annular band in which the ends of the strip are overlapped, means for placing and holding the tear tab of the cap blank in juxtaposition with said annular band and means for rolling the band up from one edge and thereby simultaneously rolling the tear tab up into the band to form the ring and provide a tight connection between the ring and the tear tab.

DESCRIPTION OF THE DRAWINGS

The accompanying drawings illustrate, by way of example, an embodiment of the invention.

In the drawings.

DESCRIPTION OF PREFERRED EMBODIMENT

In the embodiment of the invention to be described a bottle cap blank and a ring-pull blank are initially cut separately from sheet metal and are subsequently united, in a manner to be described. The ring-pull, (also referred to herein as the pulling ring) is formed from a strip of sheet material curled into an annular band with the ends of the strip overlapping as shown in FIG. 10. This strip is cut and formed as described below with reference to FIGS. 1, 2 and 7 to 10.

Figure 1:
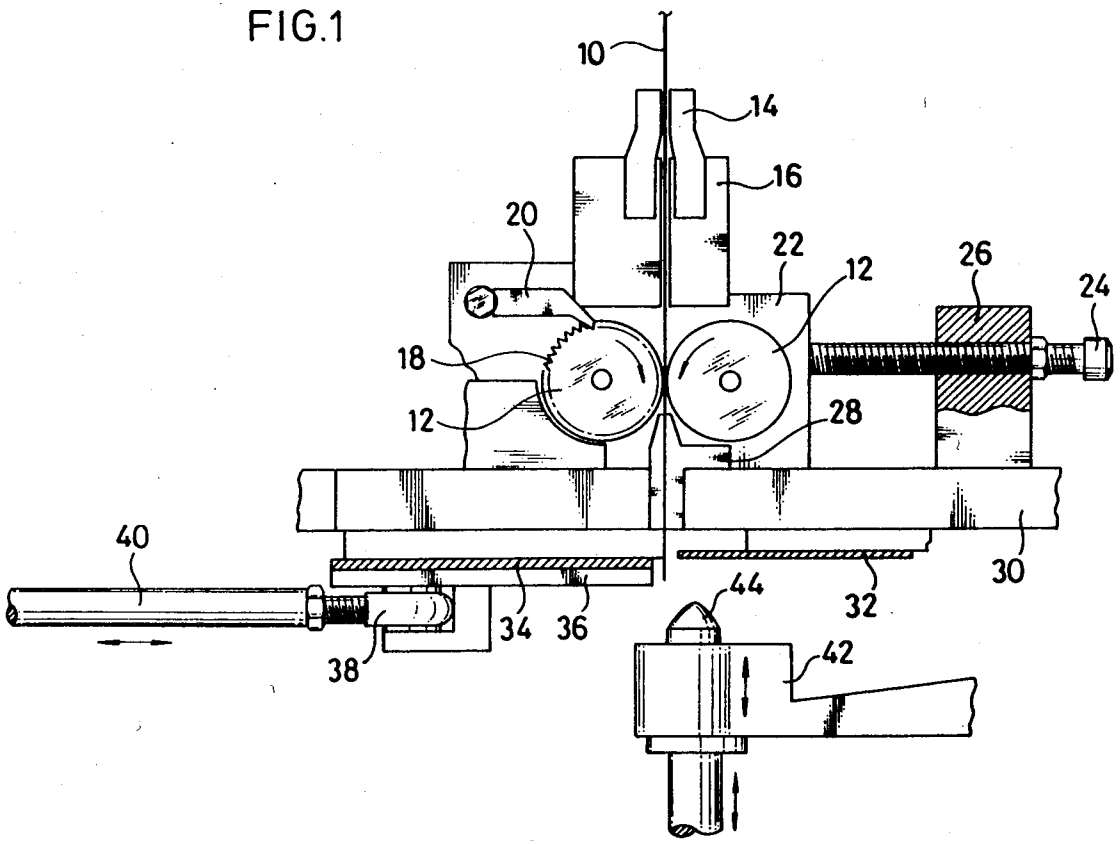
FIG. 1 is a front elevation view of a device for cutting a metal sheet strip and forming a cylindrical band, said device forming part of an apparatus embodying the invention.
Figure 2:
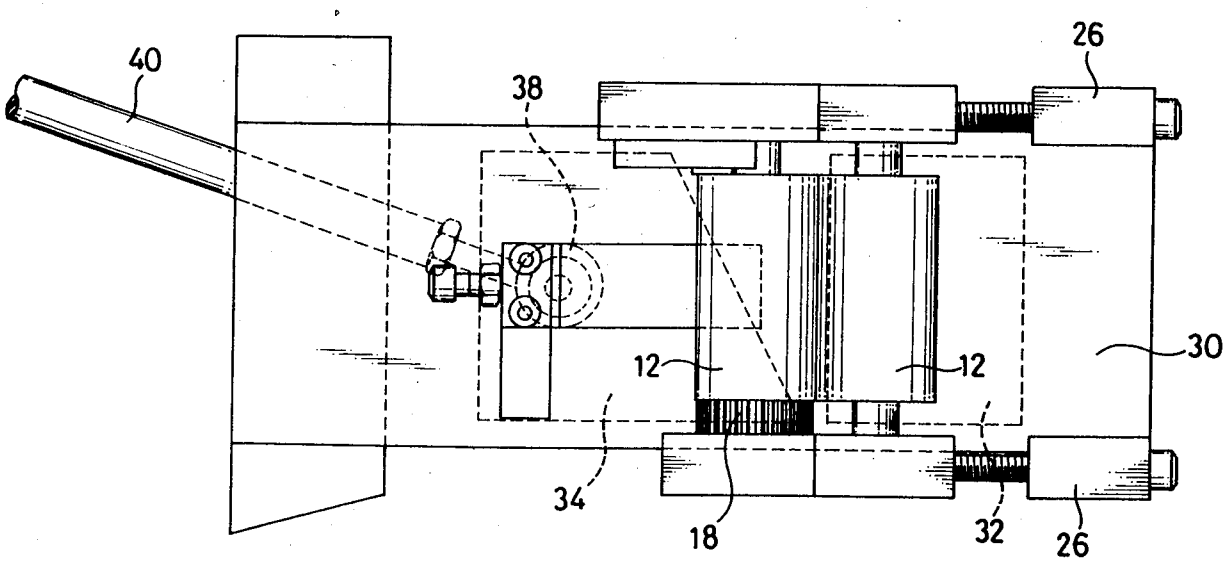
FIG. 2 is a plan view from above showing part of the cutting device of FIG. 1.

Referring to FIG. 1, a metal sheet supply strip 10 is advanced longitudinally vertically downward by means of two rotating rolls 12, between which the supply strip passes and which rolls grip the strip between them. The metal strip 10 may be made of aluminium or steel and is supplied from an upper reel (not shown). Before passing the nip between rolls 12, strip 10 is passed through a felt cleaning device 14 by means of which the strip is freed from contaminants, such as dust and oil. The device 14 comprises felt pads attached to a holder 16 which also serves as a guide for the metal strip 10. One of the rolls 12 is united with a co-axial ratchet gear 18 and a ratchet pawl 20 for stepwise feeding of the metal strip 10 by means of the rolls 12 cooperates with the ratchet wheel 18. The spacing between rolls 12, i.e. the size of the nip between the rolls is adjustable by means of screws 24 screw-threadedly engaged in respective fixed walls 26 and engaging slidable roll holders 22 carrying the other roll 12. A fixed base plate 30 is provided with a slot for passage of the strip 10 and with a guide 28 for positioning the strip 10. The base plate 30 on one side of said slot has, mounted on the underside of the plate 30, a horizontal fixed shear blade 32, while on the other side of said slot, also on the underside of the plate 30, is disposed a movable shear blade 34 which is secured to a member 36. The member 36 is slidable horizontally in guides, (not shown), secured to the underside of the base plate 30. The shear blades 32 and 34 are in the form of flat horizontal plates and the lower surface of blade 32 and the upper surface of the blade 34 lie substantially in a common horizontal plane referred to herein as the cutting plane of the shears. As shown in FIG. 2, the cutting edge of the fixed blade 32 is substantially parallel with the plane of the vertically fed strip 10, whilst the cutting edge of the movable blade 34 is inclined with respect to the plane of the strip 10. The guides for the member 36 are so arranged that the blade 34 is slidable horizontally towards and away from blade 32 in a direction perpendicular to the plane of strip 10. To a bottom surface of the member 36 is fixed a pivot pin about which is pivotable, in a horizontal plane, a bearing member 38 of a connecting rod 40, which in turn is connected to a reciprocating mechanism (not shown) for reciprocating the member 36 and thus blade 34 horizontally. The reciprocating mechanism for the rod 40 is associated with a driving device (most of which is not shown) for the roll 12. When the rod 40 is moved to the right side in FIG. 1 to cause the movable blade 34 to cooperate with the fixed blade 32 to cut a narrow band from the strip 10, the part of the driving device for the roll 12 on which the pawl 20 is carried makes a return stroke to the left and the pawl 20 passes freely over the wheel 18 without rotating the latter. When the rod 40 is moved to the left, on the contrary, so that the blade 34 makes a return stroke and is separated from the blade 32, the driving device moves the pawl 20 to the right to rotate the roll 12 and feed a further predetermined length of the metal strip 10 past the shears.

Figure 7:
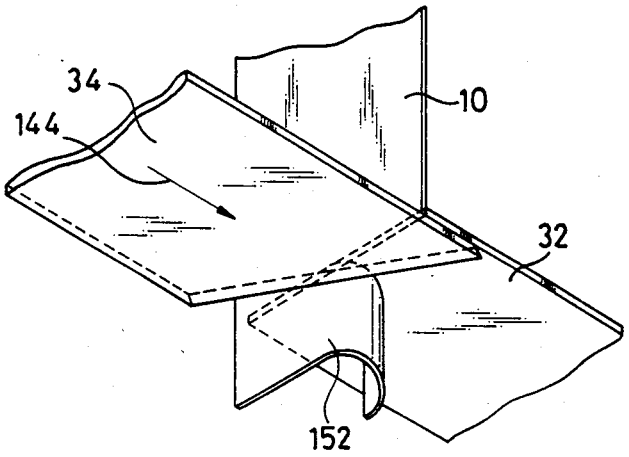
FIG. 7 is a perspective view of cutting shears showing a procedure for preparing an annular band from a strip of metal sheet.

The length by which the strip 10 is advanced at each leftward (in FIG. 1) stroke of the rod 40 is substantially less than the breadth of the strip 10, so that the portion of the strip cut off each time is in the form of a narrow band of which the longitudinal dimension corresponds with the breadth of the strip. As explained in greater detail later the operation of the shear 32, 34 is such that cutting of the strip 10 proceeds from one edge thereof to the other during a cutting operation, while simultaneously the band cut from the strip is curled up, by the phenomenon known as 'shear bow' into a cylindrical annular band with its ends overlapped, as shown in FIGS. 7 and 10. The cylindrical band thus formed is caught by a projecting mandrel 44 which is mounted on a turret 42 located below the shears as shown in FIG. 1. The turret 42, shown only partially, is mounted for indexing rotation about a vertical axis to move the mandrel 44 in succession through a plurality of working stations, in one of which the shears is disposed. Preferably, the turret has a plurality of other similar mandrels, the arrangement being such that in each indexed position of the turret a respective said mandrel is disposed in each working station.

After the annular band has been caught by the mandrel below the shears, the turret is indexed to move the mandrel to the next working station at which is disposed a feeder for bottle cap blanks.

The mandrel 44, as shown, has the general form of a cylindrical body projecting vertically upwardly through and from a base portion carried by the turret, the mandrel having a rounded nose at its upper end.

Figure 3:
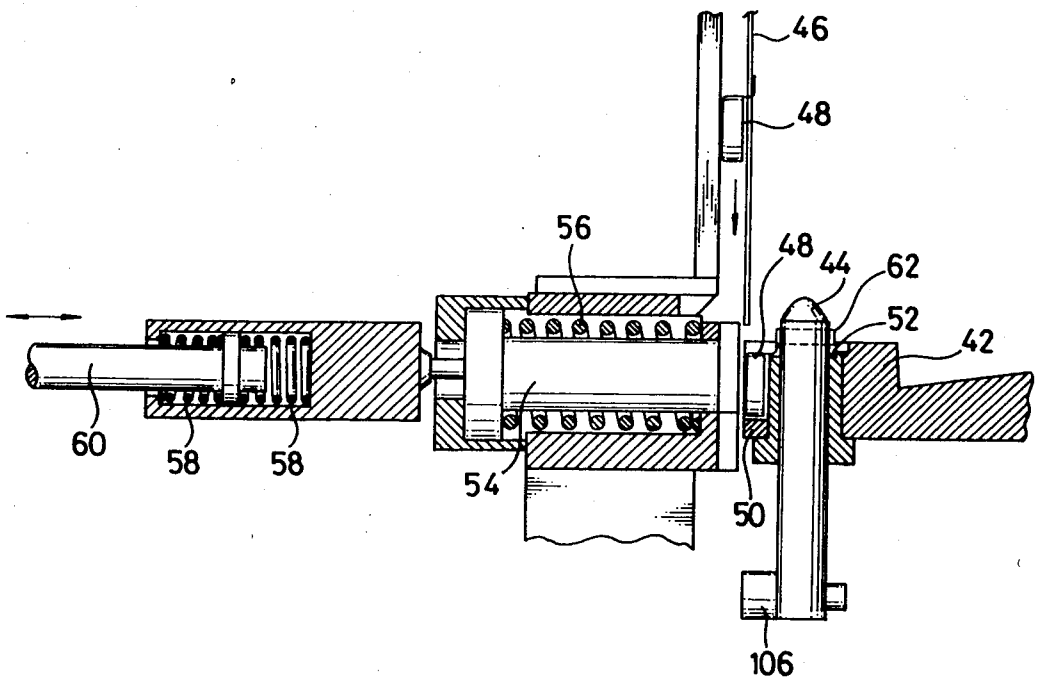
FIG. 3 is a front view partly in elevation and partly in vertical section showing of a device for feeding a bottle cap blank to a turret anvil, said device forming another part of the apparatus.
Figure 13:
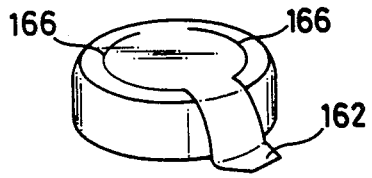
FIG. 13 is a perspective view of a bottle cap blank with a tear tab bent to lie parallel to a top surface of the cap.

In the feeder for bottle cap blanks, as shown in FIG. 3, bottle cap blanks 48 are supplied one by one, via an upper chute 46, from a store (not shown) of such blanks. Each bottle cap blank 48 is made of aluminium or steel and is made by punching blanks from a metal sheet then pressing the blanks into the cap-like form in which they are supplied from chute 46. Each cap blank 48 supplied via chute 46 has, as shown in FIG. 13, a cap portion with a flat top surface, a peripheral wall around the top and a tear tab 162 extending from the free edge of said peripheral wall in a plane parallel with that of the top surface of the bottle cap 48. Each time a mandrel 44 arrives in the working station shown in FIG. 3, a respective blank 48 is delivered to the respective portion of the turret.

The chute 46 is positioned radially outwardly (with respect to the rotational axis of the turret) from the position of the periphery of the turret and the lower end of the chute 46 terminates in a fixed cap-blank receiving cradle adjacent the periphery of the turret. The periphery of the turret has, at the location of each mandrel 44, a respective anvil 50 which affords an upwardly open U-section cavity which is also open on its side facing outwardly towards the cap blank feeder. The cradle at the lower end of the chute 46 defines a correspondingly shaped upwardly open cavity, open also on its side facing towards the turret, and aligned with the cavity in the respective turret anvil 50 in the respective indexed position of the turret. Each bottle cap blank 48 passed down the chute 46 is arranged with its tab uppermost and its open or concave side facing towards the turret, and comes to rest in this position in the cradle at the lower end of the chute. The cap blank is then pushed radially inwardly, in the direction of the turret axis, into the cavity in anvil 50, by means of a push punch 54. The push punch 54 is moved towards the turret by a shaft 60 acting on the punch 54 via a compression spring 58 and an intermediate member bearing on the punch 54, whereby the spring 58 regulates the force applied by the punch 54 on the bottle cap blank.

The punch 54 is withdrawn from the turret, after pushing the blank 48 into the anvil cavity, by a return spring 56. When the cap blank has been thus delivered to the anvil 50, the tab lies against, or closely adjacent, the outwardly pesented surface of the afore-mentioned annular band, referenced 62, on the mandrel 44. The turret is then indexed further to bring the cap blank 48 and the band 62 into the next working station, (see FIG. 4).

Figure 4:
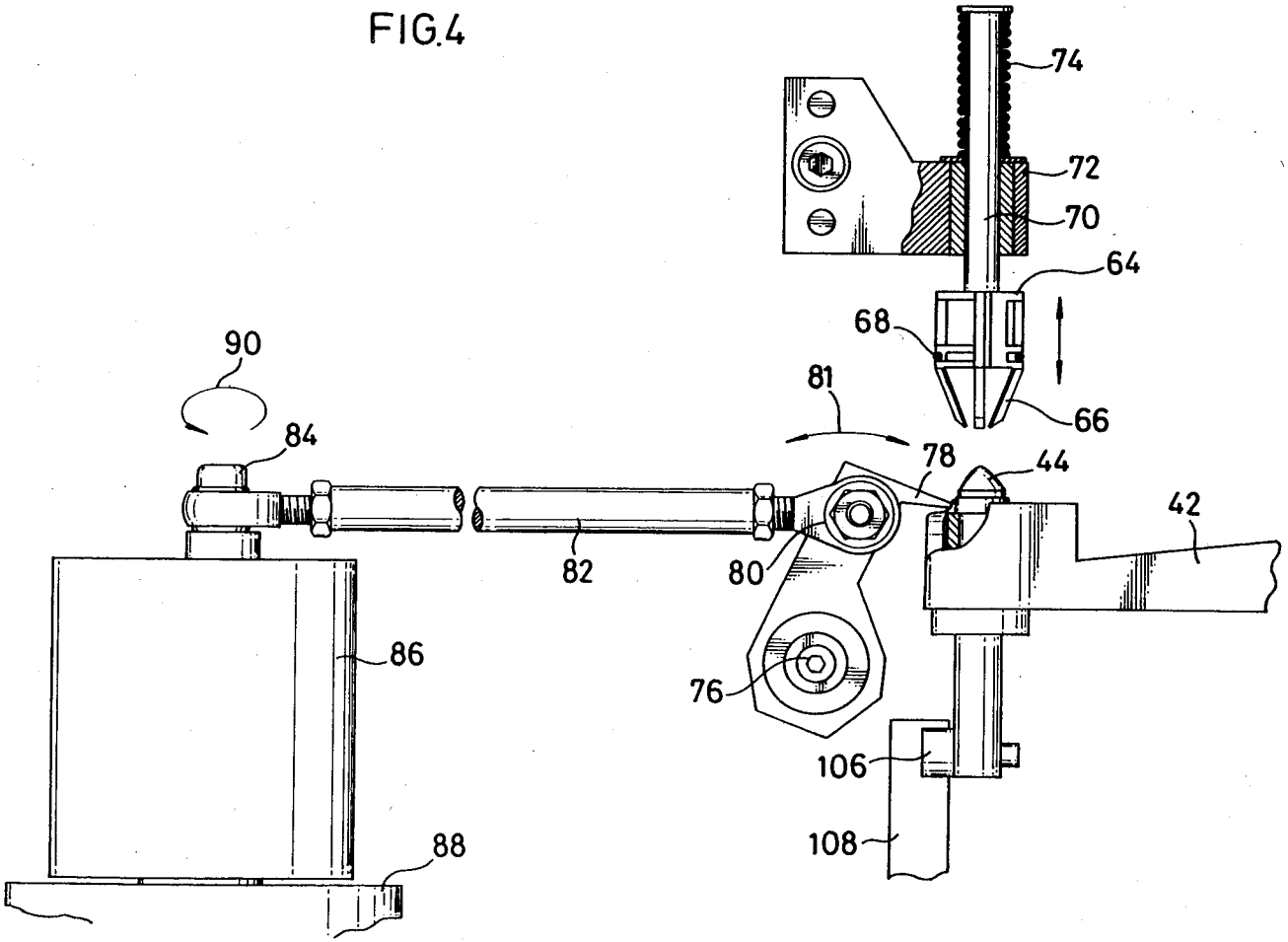
FIG. 4 is a front view partly in elevation and partly in vertical section showing another part of the apparatus including a device for pressing a ring-pull blank onto a rolling die mandrel and a device for pressing a tear tab of a bottle cap blank against the ring-pull blank.

In the working station shown in FIG. 4, a movable finger ring 64 is moved down over the mandrel 44 to engage the cylindrical band 62 and ensure that the latter is firmly engaged with the base portion 52. It will be appreciated that to ensure that the band produced by the shears fits snugly around the mandrel 44, it is initially made with an integral diameter slightly smaller than the external diameter of the lower, cylindrical part of the mandrel and thus requires to be forced slightly by the finger ring 64 onto the lower cylindrical part of the mandrel. As it will appear from what follows, the mandrel 44 and base portion 52 together from the first part of a rolling die. The finger ring 64 has plurality of downwardly extending fingers 66 drawn towards one another by a spring collar ring 68. The fingers 66 are normally relatively close together but are able to move apart when the upper end of mandrel 44 is forced therebetween. The finger ring 64 is secured to vertical shaft 70 which is supported for vertical sliding movement in a fixed guide 72. The ring 64 and shaft 70 are normally held in a raised position (shown) by a spring 74 and are lowered, against the bias of spring 74, by means (not shown) at the appropriate time to push the band 62 into position. When the cylindrical band 62 has been pushed by ring 64 into its desired position, a finger 78 supported on a pivot 76 is moved by a rod end 80 in the direction of an arrow 81 as shown in FIG. 4 to engage the bottle cap tab and press the same against the outer surface of the cylindrical band 62. The surface of the finger 78 which engages the tab has the same curvature as the band 62 or mandrel 44 so that the tab is bent or curved to lie snugly against the band 62 over the whole width of the tab. The rod end 80 is connected to one end of a shaft 82, the other end of which is provided with a rod end rotatably mounted on an eccentric pin 84 on a cam 86. A driving means for the cam 86 is arranged to rotate the same in the direction of an arrow 90 as shown in FIG. 4 by a gear arranged under a base 88.

Figure 5:
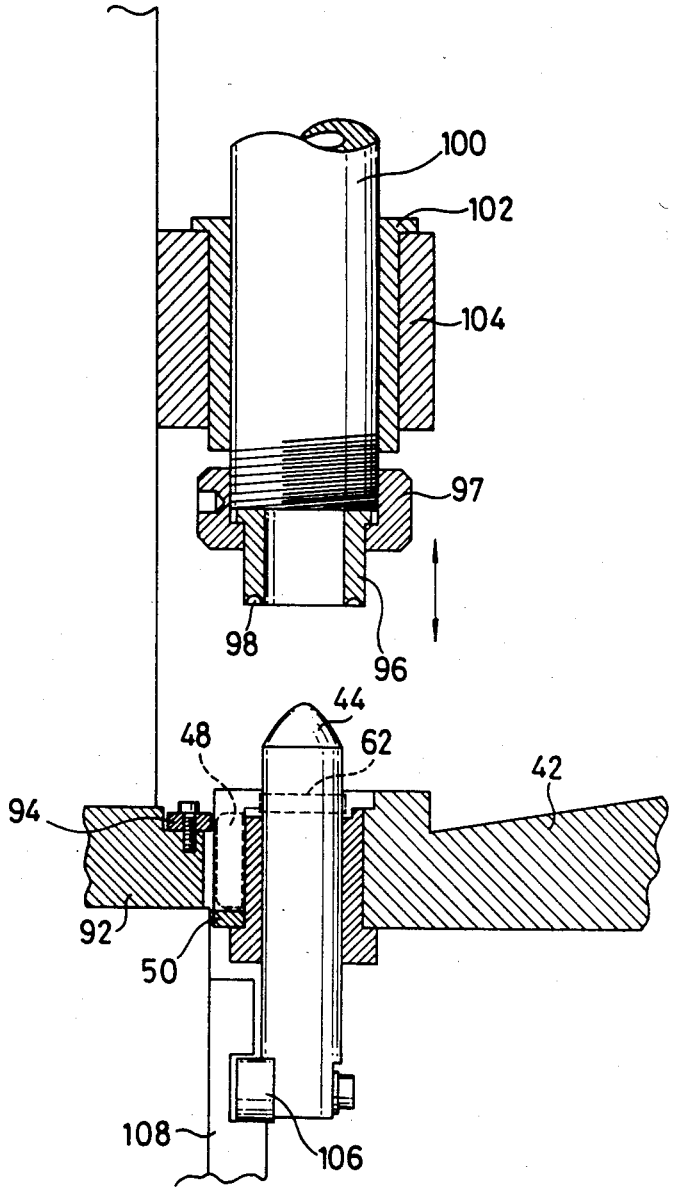
FIG. 5 is a view in vertical section, to an enlarged scale compared with FIGS. 3 and 4, showing a rolling die for rolling up the metal pulling ring blank and joining the same to a bottle cap blank.

The turret is then indexed once more to move the band 62 and cap blank 48 to the next working station as shown in FIG. 5. In order to keep the bottle cap tab in contact with the cylindrical band, the cap is engaged, during this indexing movement, with a guide 94 mounted on a fixed wall 92 the guide 92 extending around part of the circumference of the turret. In the working station shown in FIG. 5, the band 62 is rolled up from its upper edge by means of said rolling die, of which said second part is in the form of a cylindrical punch 96 having a central axial passage to receive the mandrel 44. The punch 96 is mounted for reciprocation about its central vertical axis. When the mandrel 44, with the band 62 and cap blank 48 has reached its indexed position in this working station, the punch 96 is lowered to receive the mandrel 44 in its central passage so that the cylindrical band at its upper edge is first engaged by and is then rolled up outwardly (relative to the axis of the mandrel 44) by an annular guiding curved surface 98 provided at the lower end of the curling punch 96 around the central passage in punch 96. Simultaneously the bottle cap tab is also rolled up into the ring, in the form of a toroid to make a strong joint. The punch 96 is connected by a fastening nut 97 to a shaft 100 which is an accurate sliding fit in a guide bush 102 secured on a fixed wall 104. The shaft 100 is precisely moved up and down by a driving reciprocator (not shown). The nut 97 allows a limited horizontal movement of the punch 96 relative to shaft 100 to allow self alignment of the punch 96 relative to the mandrel 44.

Thus, as the shaft 100 is moved downwards to move the member 96 over the mandrel 44, if the member 96 is not in precise axial alignment with the mandrel, it will be shifted laterally by engagement of the wall of the central passage in member 96 with the tapering upper end of the mandrel, until it comes into such alignment as the lower cylindrical part of the mandrel enters said central passage, and before the member 96 engages the band 62.

The member 96 is thus self centering relative to the mandrel and during each downward stroke of the member 96, such a centering operation takes place, if necessary, before the rolling up of the band 62 is commenced.

As indicated above, the means for cutting the metal strip and forming the cylindrical band as shown in FIG. 1, the means for feeding the bottle cap into the turret anvil as shown in FIG. 3, the means for press-contacting the bottle cap tab with the cylindrical band as shown in FIG. 4 and the curling device as shown in FIG. 5 are arranged on a circle about the turret for movement of the workpieces carried by the turret from station to station as described hereinabove. In this case, the mandrel 44 is provided at its lower end with a cam follower 106 (FIGS. 3 to 5) which moves up and down along a cam groove (FIGS. 4 and 5) in a fixed cam 108 so that the mandrel 44 is placed in a desired vertical position for each working step. The cam 108 is secured to the base 88 (FIG. 4) along its circumference.

Figure 6:
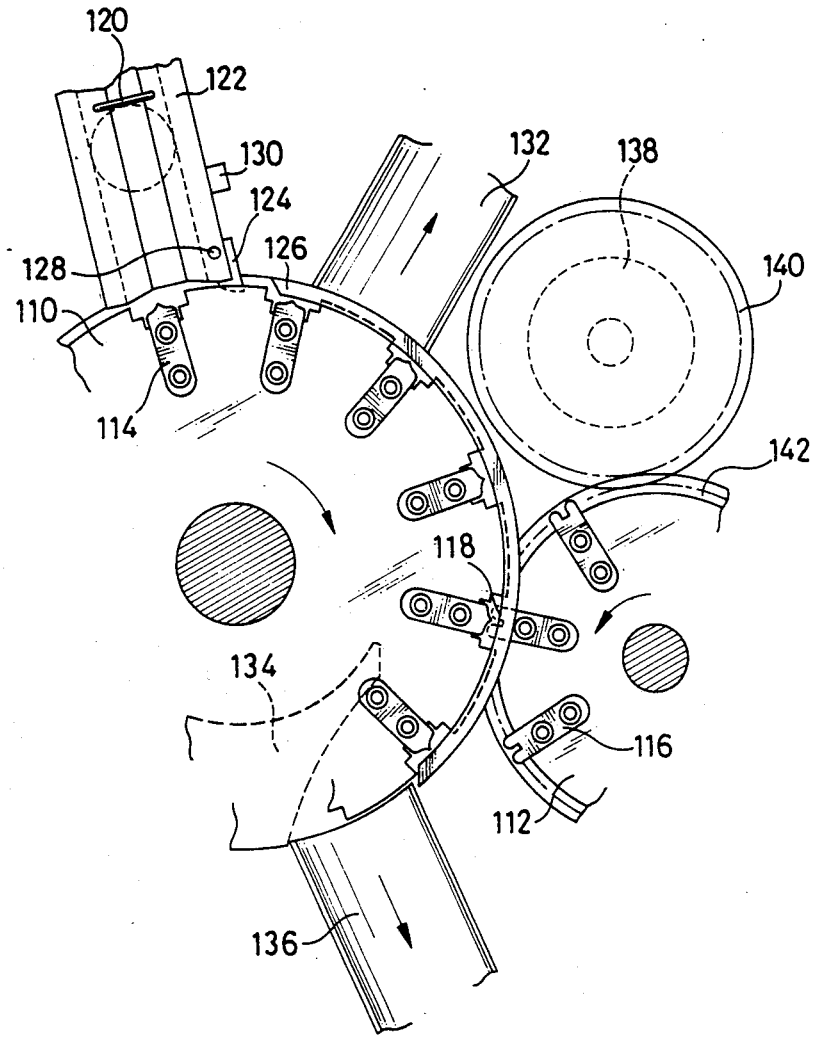
FIG. 6 is a plan view of a device, forming part of the apparatus, for embossing the region of the joint between a metal pulling ring and the bottle cap blank.

After the band 62 has, with the tab, been rolled up to form a toroidal ring, the cap blank and ring are stripped from the turret, by means not shown and the cap blanks so formed are fed one by one to an embossing device described below. In the embossing device, as shown in FIG. 6, two discs 110, 112 are rotated in association with each other, edge to edge, at equal peripheral speeds. The disc 110 is provided along its circumference with a plurality of first die parts 114, while the disc 112 is provided along its circumference with a plurality of second die parts 116. As the two discs rotate, in synchronism, each die part 114 comes into cooperation with a die part 116, at a point indicated at 118 in FIG. 6, to emboss and form further a respective workpiece (cap blank and pull-ring) held in the respective die part 114.

In the following more detailed description of the operation of the embossing device, the workpieces, i.e. the cap blanks with the rolled up, toroidal pull-rings attached thereto, as produced in the working stage of FIG. 5, are given the reference 120 to distinguish them from the less fully formed workpieces in the earlier stages of the production process. The blanks 120 are fed one by one to the disc 110 to be loaded into holders associated with the die parts 114 before these meet the die parts 116. Each blank 120 is supplied upside down with its ring projecting upwardly at its downstream end, through a chute 122 to the disc 110. In order to facilitate high speed operation, in which blanks 120 are fed constantly to the disc 110 rotated at a high speed, guides 124, 126 are provided, one of which (124) can move around a pivot 128 to actuate a sensor 130 to discontinue operation of the apparatus upon production of a distorted cap or erroneous timing of movement. In such a case, the distorted cap may be removed through a chute 132. The bottle cap blank with the ring is embossed and formed between the die parts 114 and 116 and is subsequently removed from the disc 110 by a finger 134 arranged under the disc 110, which finger transfers the product to an inlet of a chute 136 for collection. A guide 126 extends partly around the circumference of the disc 110 to the inlet position of the chute 136 from adjacent the inlet chute 122 and is secured to the base plate. The guide 126 holds the blanks 120 in their desired positions on the dics 110 but is positioned and dimensioned so as not to interfere with operation of the dies.

Figure 18:
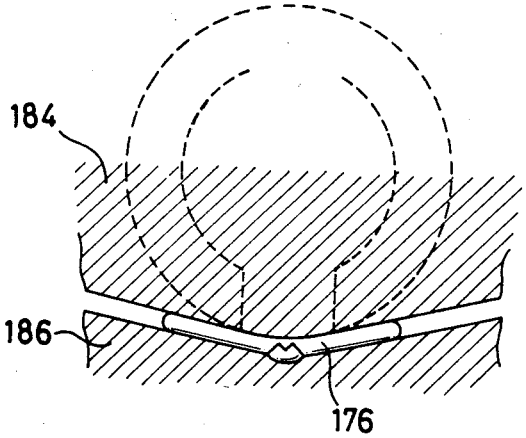
FIG. 18 is a schematic sectional view illustrating the operation of cooperating dies for bending the pulling ring about a diameter.

Above each die 114 on the disc 110 is mounted a further die 184 (FIG. 18, not shown in FIG. 6) and above each die 116 on the disc 112 is mounted a further die 186 (FIG. 18, not shown in FIG. 6). At the point 118 these further dies, between them, deform the two side parts of the rolled pulling ring towards the the center of disc 110 to follow a predetermined diameter, which for example can be somewhat bigger than that of the bottle cap. It will be appreciated that the cap blanks 120 have the general form shown in FIG. 16, with the ring lying in a plane perpendicular to that of the top of the cap portion, and thus parallel with the axis of the cap portion. The further dies referred to effectively bend the ring about its diameter parallel with the axis of the cap portion, to bring the sides of the ring closer to the axis of the cap portion, so that the ring is generally concave towards the axis of the cap portion, for example lying in an imaginary cylindrical surface co-axial with the cap portion but having a somewhat larger diameter than the cap portion. The dies 114 and 116, as explained below, act to emboss or locally deform the ring in the region thereof incorporating the rolled up tab, to strengthen the connection of the tab with the ring. In FIG. 6, reference 118 indicates the position at which the dies carried by disc 110 come into cooperation with the dies carried by disc 112 to carry out the described deformation and further shaping of the rings.

The discs 110 and 112 are rotatably driven by a motor 138, through a gear 140 attached thereto, a gear 142 fixed with respect to the disc 112 and a gear (not shown) arranged under the disc 110 and fixed with respect thereto.

Figure 8:
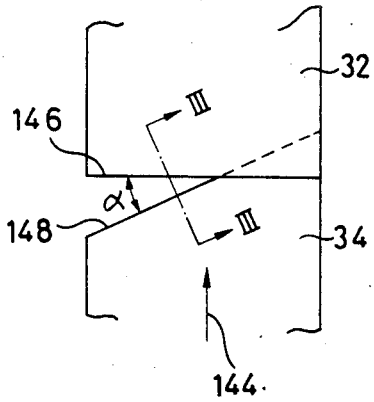
FIG. 8 is a plan view showing the angular relation between the cutting edges of fixed and movable blades of the shears at FIG. 7.
Figure 9:
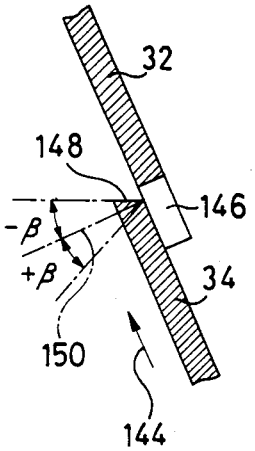
FIG. 9 is a sectional view taken along the lines III—III of FIG. 8.
Figure 10:
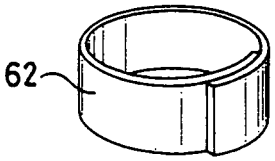
FIG. 10 is a perspective view of an annular band forming a ring-pull blank.

Referring to FIGS. 7, 8 and 9, the operation of the shears comprising the fixed blade 32 and a movable blade 34 will be described in more detail. In FIG. 8, arrow 144 indicates the horizontal axis along which the movable blade 34 is reciprocated relative to the fixed blade 32. The cutting edge of the fixed blade 32 is perpendicular to the axis 144, while the angle between the cutting edge of the fixed blade edge 32 and the cutting edge of the movable blade 34 is an acute angle of $\alpha$ degrees. The cutting edge of the fixed blade 32 is formed by the intersection of the lower planar surface of blade 32 with an edge face 146 perpendicular to said lower surface but the cutting edge of the blade 34 is formed by the intersection of the upper planar surface of blade 34 with an edge face 148 which meets said upper surface in an obtuse angle, i.e. a negative angle of rake, indicated at $-\beta$ in FIG. 9, as opposed to a positive angle of rake such as indicated schematically by $+\beta$ in FIG. 9, angles $-\beta$ and $+\beta$ being reckoned as deviations from the perpendicular 150 to the cutting plane. The angles $\alpha$ and $\beta$ are so chosen that in shearing the strip 10, shear bow operates to give a cylindrical band and a non-spiral shaped ring. For example, where $\alpha$ is in the range of 20–40 degrees, $\beta$ may be in the range of $-0.5$ to $-2.5$ degrees.

In operation of the device of FIGS. 1 and 2, a predetermined length of a metal sheet 10 is inserted normally between the fixed blade 32 and the movable blade 34. Then, the movable blade 34 is slid toward the fixed blade 32 to apply a shearing force to the metal sheet 10. Thus, a cut metal strip (indicated at 152 in FIG. 7) is subjected to both an axial and a normal force by proper selection of the angles $\alpha$ and $\beta$ to form a cylindrical band 62 with its opposite ends being overlapped as shown in FIG. 10.

Figure 11:
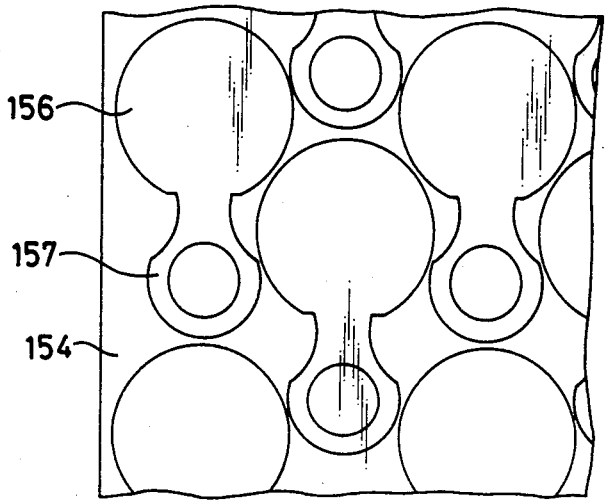
FIG.11 PRIOR ART
FIG. 11 is a plan view of a portion of a metal sheet having marked thereon the outlines of bottle cap blanks of the prior art, showing the proportion of the metal sheet which will be turned into scrap.

FIG. 11 shows part of a metal sheet 154 with, outlined thereon, a plurality of flat blanks 156 such as are used to form ring-pull bottle caps of the prior art, in which the pulling-rings are formed integrally with the pulling tab and the bottle cap. Thus each blank 156 is provided with a portion 157 destined to form a pulling-ring. As is apparent from FIG. 11, the particular configuration of the blanks 156 entails inevitably considerable waste of material.

Figure 12:
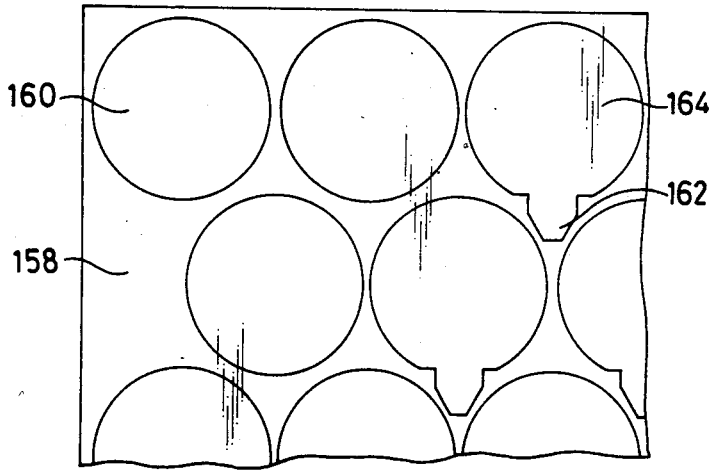
FIG. 12 is a corresponding plan view of a portion of a metal sheet having marked thereon the outlines of bottle cap blanks required in a method embodying the invention, showing the saving in scrap effected.

FIG. 12 shows part of a metal sheet 158 with, outlined thereon a plurality of flat blanks 164 to be used to form the cap portions of ring-pull caps according to the above described embodiment of the invention, said blanks being in the form of discs each having a triangular tab 162 for subsequently stamping out and preparing bottle caps. FIG. 12 also shows, for comparison several discs 160, of the same size as the circular parts of blanks 164. As is apparent from FIG. 12, the material loss entailed in production of blanks 164 may be minimised to an even greater extent than entailed in production of perfect discs. Each piece 164 after stamping out of the flat sheet is then press-molded after having been provided with continuous score lines or cuts 166, extending only partly through the thickness of the material, to form a bottle cap blank with a tear tab 162, as shown in FIG. 13. The tear tab 162 is bent normally to the axis of symmetry of the cap portion, i.e. to lie parallel with a top surface of the cap portion.

Figure 16:
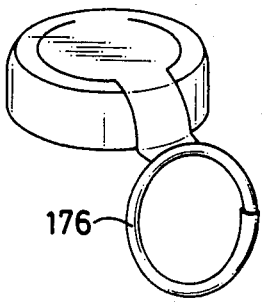
FIG. 16 is a perspective view showing a bottle cap blank with a pulling finger ring fitted thereto by a method embodying the invention.

As shown in FIGS. 13 and 16, the cap portion of the cap blank has two score lines 166, i.e. lines along which the material is cut to less than the full thickness of the material forming the cap. (These lines, although normally formed by stamping, rather than by scoring, are herein for convenience referred to as 'score lines'). Each score line 166 extends from a respective one of the two opposite edges of the tab 162 where the latter joins the rim of the cap portion and continues up over the rim and onto the flat top of the cap portion so that when, in the finished cap, applied to a bottle, the ring 176, and thus the tab 162 is pulled, the tab 162, and with it the region of the cap portion lying between the score lines 166 will be torn, along the score lines, from the remainder of the cap, to remove the cap from the bottle.

Figure 14:
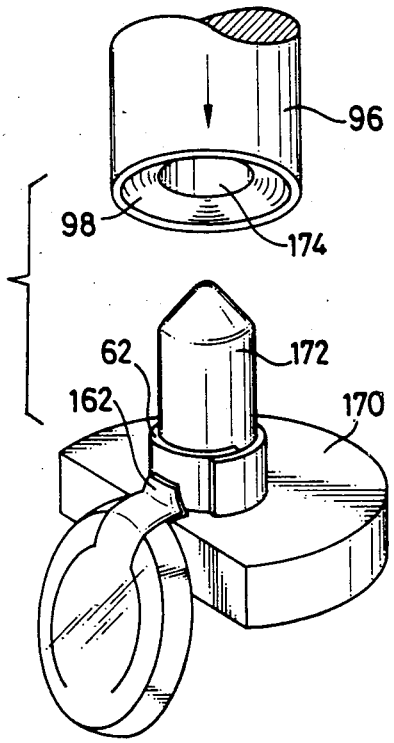
FIG. 14 is a diagrammatic perspective view showing the operation of the device of FIG. 5.

FIG. 14 shows in greater detail, and in perspective, the rolling die, the second die part of which comprises the cylindrical curling punch 96 and the first die part of which comprises the base portion 170, (referenced 52 in FIG. 3) and the upright projecting mandrel rod 172 (referenced 44 in FIGS. 3 to 5) with a conical top. The punch 96 is provided therethrough with said central passage, referenced 174, for receiving the mandrel 172 of the die. Furthermore, the punch 96 is provided at its lower end with a said annular die surface, (referenced 98), which is concave and serves as a curling or rolling guide. As seen in FIG. 14, the cylindrical band 62 is fitted around the mandrel 172 and engaged with the die base 170. Then, the tear tab 162 at its inner face is contacted with the outer surface of the cylindrical band 62, while the cap itself is positioned under the level of the upper surface of the die base 170. The tab 162, as described above, is urged against the cylindrical band 62 by means of a press bar (not shown in FIG. 14) having a curved surface corresponding to the curvature of the cylindrical band 62. Thus, the tab 162 is deformed to be curved concentrically with the cylindrical band 62. Then, the curling punch 96 is moved down over the mandrel 172 to engage the band 62 and apply a curling or rolling pressure to the cylindrical band 62.

It will be noted from FIG. 14 that, in the position shown in that figure, the upper, free end of tab 162 stops below the upper edge of the cylindrical band 62.

It will also be noted from FIG. 14 that the portion of the band 62 against which tab 162 is placed, and which is rolled up around and within the tab, is outside the zone of overlap of the ends of the band.

Figure 15A:
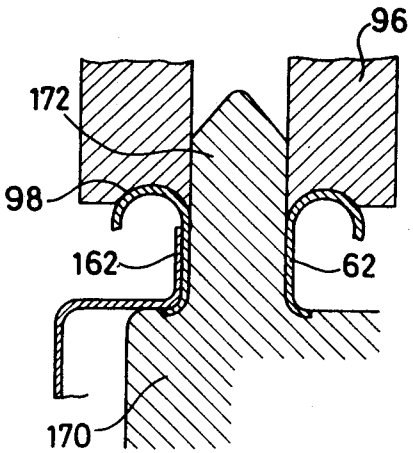
FIGS. 15A to 15C are schematic views in vertical section showing successive stages in the operation of the device of FIG. 5.
Figure 15B:
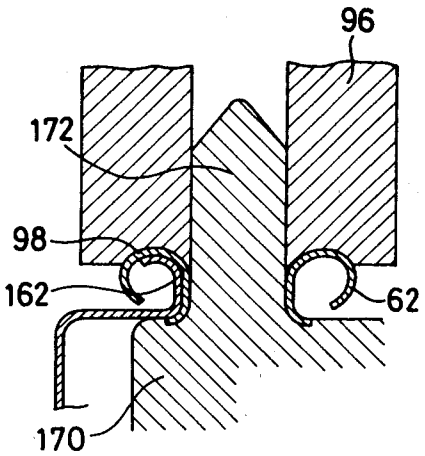
Figure 15C:
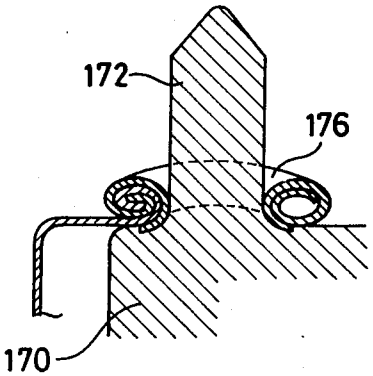

FIGS. 15A to 15C show the rolling or curling procedure in detail and illustrate the manner in which the cylindrical band is connected to the tear tab of the cap. In FIG. 15A, the guide surface 98 of the punch 96 has urged the upper edge of the cylindrical band 62 radially outward and downward somewhat. During further downward movement of the punch 96, the cylindrical band 62 is further curled or rolled, together with the tab 162, as shown in FIG. 15B. Finally, as shown in FIG. 15C the cylindrical band 62 is tightly rolled up and completely integrated with the interleaved, similarly rolled up tab 162 tear tab to provide a ring 176 firmly connected with the tab. Thus the bottle cap with a pulling finger ring 176 is complete, as shown in FIG. 16.

Figure 17:
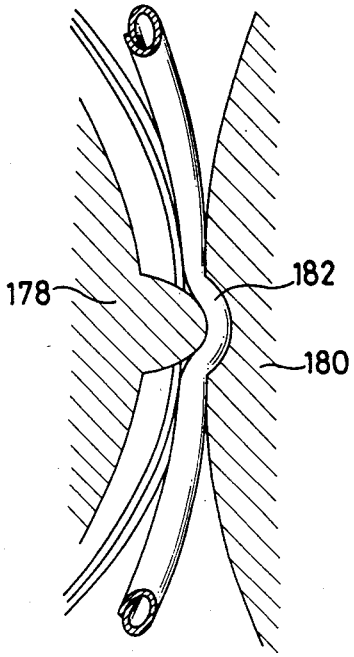
FIG. 17 is a schematic sectional view illustrating the operation of the embossing means for strengthening the connection between a pull-ring and a tear tab of a bottle cap blank.

FIG. 17 shows how the joint between the bottle cap tab and the ring is made stronger and stiffer by the use of embossing moulds or dies. In FIG. 17, the embossing dies, referenced 114 and 116 in FIG. 6, are referenced 178 and 180, respectively and are shown only partially, to an enlarged scale. As shown, the die 178 has a convex projection 178 which cooperates with a concave recess in the die 180 to form, in the portion of the ring gripped therebetween, (which is the portion within which is the rolled-up tab 162) a crease 182 which extends across the middle of the joint between the tab and the ring and also along a part of the tab along the middle axis thereof. FIG. 18 shows at 184 and 186, in section, and only partially, the further dies mounted respectively on the discs 110 and 112 of FIG. 6. These dies, comprising a convex die 184 and a complementary concave die 186 bend the side parts of the ring 176 inwards to make the ring, when viewed along the axis of symmetry of the cap portion, follow, at least approximately, a circle concentric with the cap but with a diameter which normally is somewhat bigger than the diameter of the bottle cap.

The dies 184 and 186, instead of bending the ring arcuately, may, of course, simply bend it into a shallow V-shape with the internal angle of the 'V' facing towards the cap axis.

Among the advantages of the embodiment of the invention described, are the features that flat metal blanks, the metal pieces for preparing the bottle caps, may be cut from a metal sheet with a minimum of scrap loss and the cylindrical bands for preparing the pulling rings may be separately prepared from another metal sheet in strip form without production of scrap. Nevertheless, the pulling finger rings are firmly connected to the tear tabs of the bottle caps. Thus, the method and apparatus described are suitable for the mass production of ring-pull bottle caps at low cost.

I claim:

1. A method of manufacturing a ring-pull bottle cap from a cap blank formed with a tear tab, comprising the steps of forming a pulling ring blank by cutting a strip from a metal sheet and curling the strip to form an annular band in which the ends of the strip are overlapped, providing a bottle cap blank that comprises a cap portion generally symmetrical about an axis thereof with a tear tab that extends from the rim of said cap away from the said axis of the cap and tapers in width away from said axis and wherein the cap portion is formed with a score line or cut extending only partially through the thickness of the cap material and extending over the cap from the junction of one edge of the tab with the rim, and a like score line or partial cut extending over the cap from the junction of the other edge of the tab with the rim, whereby a part of the cap portion integral with the tab and divided from the remainder by said score lines or cuts, can be torn from said remainder by pulling the tab, placing the tear tab of the cap blank in juxtaposition with said annular band, and rolling the band up from one edge, thereby simultaneously rolling the tear tab up into the band to form the ring and provide a tight connection between the ring and the tear tab.

2. A method according to claim 1 wherein the tear tab is placed against the exterior of the band, and wherein the annular band is rolled up outwardly from said one edge.

3. A method according to claim 1 wherein said pulling ring blank is formed by severing from the end of a first sheet metal strip, by means of a transverse cut extending entirely across the first strip, an end portion of the first strip, which end portion is substantially shorter in the longitudinal direction of the first strip than in the direction of said transverse cut.

4. A method as claimed in claim 1 wherein in placing said tear tab in juxtaposition with said annular band, the tear tab is placed against the band so that the free end of the tear tab lies against the band intermediate the edges thereof and spaced from the edge from which the band is subsequently rolled up, the tear tab extending from said free end, against the band, towards the opposite edge of the band, and wherein the band is rolled up from the respective edge thereof by moving a forming die part axially into engagement with the band from the end thereof defined by said respective edge.

5. A method as claimed in claim 3 wherein said first strip is advanced longitudinally between the separated blades of a shear by an amount substantially smaller than the width of the strip, and the shear blades are then brought together to cut the first strip, the cutting edge of one of said shear blades being inclined with respect to the other so that the strip cut off from the first strip is cut off progressively from one edge of said first strip to the other and is simultaneously curled to form said annular band by shear bow.

6. A method as claimed in claim 5 wherein said shear has a fixed blade with a cutting edge substantially parallel with the major surfaces of the uncut said first strip, and a movable blade having a cutting edge inclined with respect to that of the fixed blade and lying substantially in a common plane with that of the fixed blade, wherein the cutting off of the strip which is to form the annular band from the first strip is effected by advancing the movable blade towards the fixed blade in a direction generally perpendicular to the cutting edge of the fixed blade and parallel with the common plane of said cutting edges, and wherein said cutting edge of the movable blade is formed by the intersection with a face of said movable blade lying in said common plane of an edge face which meets said face lying in said common plane in an obtuse angle.

7. A method as claimed in claim 1 wherein the rolling up of the band is effected in a rolling die comprising a first die part including a base portion and a mandrel projecting from the base portion, and a second die part having a central passage to receive the mandrel, an annular working surface extending around said central passage, said annular working surface being curved concavely as viewed in section along the axis of said central passage, the annular band being placed around said mandrel when said die parts are separated, the tear tab being subsequently placed against the side of the annular band below the level of the edge thereof furthest from said base portion, with the free end of the tear tab being further from said base portion, and the second die part then being advanced axially towards the first die part so that said mandrel enters said central passageway and said working surface subsequently engages the upper edge of the annular band to displace the upper edge of the band progressively outwardly and downwardly over said working surface to roll up the annular band, and with it said tear tab.

8. A method according to claim 7 wherein said mandrel has a tapered free end and said second die part is mounted for limited movement transverse to its axis, whereby the second die part is centered on the mandrel as the mandrel enters said central passage.

9. A method according to claim 7, wherein the portion of the annular band against which the tear tab is placed is outside the zone of overlap of the ends of the band.

10. The method of claim 1 wherein, after the annular band and the tear tab have been rolled up together to form the ring, the connection between the ring and the tear tab is strengthened by local deformation of the ring under pressure, in the region of the ring in which the tear tab is rolled up.

11. The method of claim 1 wherein, at a point after the annular band and the the tear tab have been rolled up together to form the pull ring, the pull ring lies with its axis perpendicular to the cap axis, and wherein side parts of the ring are thereafter bent towards the cap axis so that the ring is generally concave towards the cap axis.

12. Apparatus for manufacturing a ring-pull bottle cap comprising a carrier movable to position a mandrel thereon successively at each of a plurality of work stations, means at a first one of said stations for cutting a strip from a metal sheet and curling the strip to form an annular band with overlapped ends to be received by said mandrel when at said first station, means at a second station for feeding a bottle cap blank formed with a tear tab to a position with the tear tab in juxtaposition with said annular band carried by said mandrel thereat, and means at a third station for rolling the annular band carried by said mandrel about one edge thereof and about the cap tear tab in said juxtaposed relation thereto to form a pull ring tightly connected to the tear tab, said strip cutting and curling means, bottle cap blank feeding means and band rolling means being operated in timed relation to movement of said carrier.

13. Apparatus according to claim 12, wherein said means for rolling the band about one edge comprises a rolling die having a first die part including a base portion and a mandrel projecting from the base portion, and a second die part having a central passage to receive the mandrel and an annular working surface extending around said central passage for engagement with and rolling over of said edge of the annular band, to form the ring and provide a tight connection between the ring and the tear tab.

14. Apparatus according to claim 13 wherein said mandrel has a tapered free end of said second die part is mounted for limited movement transverse to its axis, whereby the second die part can center itself automatically in relation to the mandrel by displacement in response to engagement of the tapered portion of the mandrel with said central passage.

15. Apparatus according to claim 13 wherein said first die part is carried by a turret which can be indexed rotationally about an axis thereof for transporting a said annular band engaged around said mandrel and a bottle cap blank associated therewith successively through said plurality of working stations, said second die part being disposed in one of said working stations.

16. Apparatus according to claim 15 wherein said turret also carries, associated with said first die part, an anvil for receiving and supporting a bottle cap blank in a position in which a said tear tab of the cap blank is in juxtaposition with said mandrel and said feeding means feeds a bottle cap blank with a tear tab to said anvil.

17. Apparatus according to claim 16 wherein means is provided between said second and third working stations for pressing the tear tab of a cap blank held in said anvil against an annular band located around the associated mandrel.

18. Apparatus according to claim 12 including means for embossing the portion of the rolled up annular band in the region thereof incorporating the tear tab to strengthen the connection between the pull-ring and the tear tab.

19. Apparatus according to claim 12 wherein said means for cutting a strip comprises a shear having a fixed blade and a movable blade with respective cutting edges, means for feeding a sheet metal supply strip to said shear longitudinally by increments substantially smaller than the width of the strip, so that the longitudinal dimension of the sheet metal strip, in the region of said shear, extends generally perpendicular to the cutting plane of the shear and the plane of the strip lies generally parallel with the cutting edge of the stationary shear blade, the cutting edge of the movable blade being inclined with respect to that of the fixed shear blade, means mounting said movable blade for cutting movement parallel with said cutting plane towards and away from the fixed blade and means for moving said movable shear blade to execute such a cutting movement between successive said increments of advance movement of said supply strip, to sever from said supply strip to form a said annular band and simultaneously curl the severed strip by shear bow to form a said annular band.

20. Apparatus according to claim 19 wherein said movable blade has a first face extending substantially in said cutting plane and an edge face which meets said first face in an obtuse angle, and wherein the cutting edge of the movable blade is formed by the intersection of said first face with said edge face.

21. Apparatus according to claim 19 wherein said means for feeding said supply strip by increments to said shear comprises a pair of cooperating rolls defining therebetween a nip for passage of the supply strip, ratchet drive means for at least one of said rolls, and means connecting said ratchet drive means with said means for moving said movable shear blade whereby advance movement of the supply strip is synchronised with cutting movement of said movable shear blade.

22. Apparatus according to claim 17 wherein means is provided at one of said working stations for pushing a said annular band to be formed into a pull-ring, and engaged over said mandrel, fully onto the mandrel to engage said base portion of said first die part.

23. Apparatus according to claim 18 wherein said embossing means comprises a first and a second disc mounted for rotation about respective axes thereof and means for rotating said discs in opposite directions at equal peripheral speeds, said first disc having at intervals around the periphery thereof respective first dies and said second disc having at corresponding intervals around the periphery thereof respective second dies, the means for rotating the two discs being so coupled together that as the discs rotate, each said first die in turn comes into cooperation with a said second die to deform and emboss between the dies a workpiece carried by said first disc, means by supplying bottle cap blanks with pull-rings secured by tear tabs thereof to said first disc and means on said first disc for holding each blank so supplied in a desired position relative to a said first die prior to and during its cooperation with the respective second die to emboss the pull-ring in the region of its connection with the tear tab between the first and second dies and means for thereafter removing the embossed cap blanks from the first disc.

24. Apparatus according to claim 23 wherein said first and second dies are formed so as also to bend the pull-ring of a cap blank engaged therebetween about a diameter passing through the junction of the ring-pull with the tear tab.

25. Apparatus according to claim 12 in which said carrier is a turret carrying a plurality of mandrels and mounted so as to be rotationally indexed about an axis thereof for positioning said mandrels successively at said work stations.

* * * * *